US005365628A

United States Patent [19]

Evensen

[11] Patent Number: 5,365,628

[45] Date of Patent: Nov. 22, 1994

[54] ROLLER ASSEMBLY FOR ROTARY BUFFER

[76] Inventor: Kenneth Evensen, 820 Central, Roselle, Ill. 60172

[21] Appl. No.: 168,042

[22] Filed: Dec. 15, 1993

[51] Int. Cl.[5] ..... B24B 29/00; A46B 13/02

[52] U.S. Cl. ..... 15/23; 15/97.1; 15/246; 451/358

[58] Field of Search ..... 15/97.1, 23, 24, 49.1; 51/170 PT

[56] References Cited

U.S. PATENT DOCUMENTS

| | | | |
|---|---|---|---|
| 1,325,937 | 12/1919 | Fox | 15/23 |
| 3,790,980 | 2/1974 | Sylvie | 15/23 |
| 3,793,782 | 2/1974 | Bowling | 15/23 |
| 4,398,374 | 8/1983 | Amann et al. | 51/31 |
| 4,499,624 | 2/1985 | Bloome et al. | 15/97.1 |
| 4,570,278 | 2/1986 | Bloome et al. | 15/97.1 |
| 4,907,371 | 3/1990 | Shoda et al. | 51/33 R |
| 4,959,884 | 10/1990 | Ingermann et al. | 15/302 |

*Primary Examiner*—Edward L. Roberts
*Attorney, Agent, or Firm*—Thomas R. Vigil

[57] ABSTRACT

A roller assembly adapted for use on a conventional hand held rotary disk buffing machine including a motor with a drive shaft extending from the motor, the roller assembly comprises a bracket assembly including a first bracket and a second bracket, each of the brackets have a proximal portion and a distal portion, and the proximal portion is mounted to the machine, an axle, structure for rotably mounting the axle transversely of the machine on the distal portions of the brackets, a first pulley attached to the drive shaft, a second pulley attached to the axle, structure for coupling the pulleys and for rotating the axle when the drive shaft is driven by the motor and at least one roller mounted to the axle.

18 Claims, 6 Drawing Sheets

ROLLER ASSEMBLY FOR ROTARY BUFFER

BACKGROUND OF THE INVENTION

1. Field of the Invention

The present invention relates to a roller assembly which is adapted for use with a conventional hand held, motor powered rotary disk buffing machine generally used for the repair and the restoration of furniture.

2. Description of the related art including information disclosed under 37 CFR §§1.97–1.99

Heretofore, a number of roller buffer devices have been proposed for other uses. Examples of some of these devices are disclosed in the following U.S. Patents:

| U.S. Pat. No. | Patentee |
|---|---|
| 4,959,884 | Ingermann et al. |
| 4,907,371 | Shoda et al. |
| 4,570,278 | Bloome et al. |
| 4,499,624 | Bloome et al. |
| 4,398,374 | Amann et al. |

The Ingermann et al. U.S. Pat. No. 4,959,884 discloses a bowling lane stripper and dressing apparatus. This apparatus includes a carriage movable along the entire length of the bowling alley. A reversible drive mechanism is connected to the carriage and has a drive shaft operative to advance the carriage along a predetermined course in both a forward and reverse direction. The carriage has a lane buffing mechanism in the rear section thereof, which includes a roller and a drive, the roller is journaled for rotation with its surface in lane contacting relationship about an horizontal axis extending transversely of the direction of travel. Lane-dressing structure including a reservoir for storing lane dressing fluid is connected to the lane buffing roller. The fluid can be transferred from the reservoir to the surface of the lane-buffing roller.

The Shoda et al. U.S. Pat. No. 4,907,371 discloses an automatic polishing machine. The automatic polishing machine can polish a curved skin, such as a skin on the bottom of an airplane, automatically and efficiently along a three dimensional plane of the skin. The automatic polishing machine comprises a horizontal beam extending between the upper portions of a pair of fixed vertical columns. A carriage is mounted for movement along a horizontal rail on the beam. A slider, which is attached to the carriage, is capable of upward or downward movement. A turning member is mounted on the slider and is capable of forward and backward turning movement. A rocking member, mounted for up and down rocking motion on the turning of the turning member, carries a spindle for carrying and rotating the buffer thereon. Accordingly, the buffer can move leftwardly or rightwardly in an integral relationship with the carriage, or upwardly or downwardly in an integral relationship with the slider, or if the turning member is turned the buffer is integrally inclined.

The Bloome et al. U.S. Pat. Nos. 4,570,274 and 4,499,624 disclose a portable polisher and buffer apparatus for surface preparation or for surface repair of substrates, such as sheet aluminum. This apparatus includes elongated polish rolls that are driven by a motor in conjunction with a suitable counter rotating drive arrangement such that one polishing roll rotates in a clockwise direction about its elongate axis and another polishing roll rotates in a counterclockwise direction about its elongate axis. The apparatus may also include features for counter oscillating the polishing rolls about the their respective longitudinal axes.

The Amann et al. U.S. Pat. No. 4,398,374 discloses a polishing machine having a rotary reciprocating shaft. The machine has a tool carrying spindle driven with a combined rotating and rocking action.

SUMMARY OF THE INVENTION

According to the present invention there is provided a roller assembly adapted for use on a conventional hand held rotary disk buffing machine which includes a motor with a drive shaft extending from the motor. The roller assembly comprises a bracket assembly including a first bracket and a second bracket. Each of the brackets has a proximal portion and a distal portion. The proximal portion is mounted to the machine. The assembly further comprises an axle, structure for rotably mounting the axle transversely of the machine on the distal portions of the brackets, a first pulley attached to the drive shaft, a second pulley attached to the axle, structure for coupling the pulleys for rotating the axle when the drive shaft is driven by the motor, and at least one roller mounted to the axle.

DESCRIPTION OF THE PREFERRED EMBODIMENT

Figure 1:
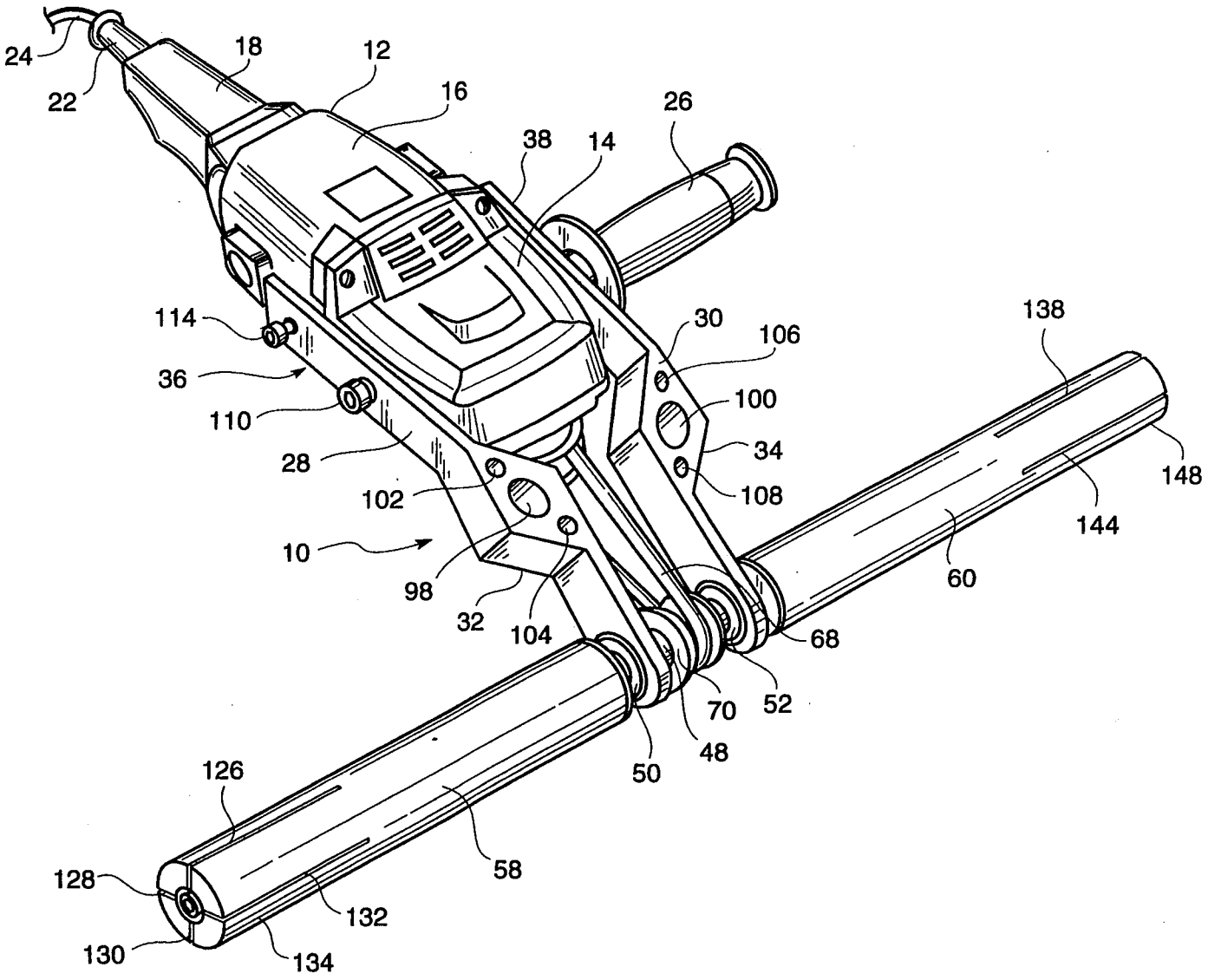
FIG. 1 is a top perspective view of one embodiment of a roller assembly mounted on a conventional hand held rotary disk buffing machine.

While the roller assembly of the present invention is susceptible of several constructions, there is shown in FIGS. 1–9 several preferred embodiments of such an assembly constructed according to the teachings of the present invention with the understanding that the present disclosure is not intended to be limited to the specific construction disclosed herein and illustrated in the drawings.

Illustrated in FIG. 1 is one embodiment of a roller assembly 10 mounted on a conventional hand held rotary disk buffing machine 12.

The conventional hand held disk buffing machine 12 has three sections: a metal motor unit 14, a plastic intermediate housing 16 and a plastic rear handle 18. A motor (not shown) is located within the motor unit 14. An on-off trigger switch 20 is located on the rear handle 18 of the machine 12 and a strain reliever 22 and electric power cord 24 for powering the motor unit 14 extend rearwardly from the rear handle 18.

A side handle 26 is also mounted to the motor unit 14 of the machine 12. The side handle 26 extends transversely of the motor unit 14 and can be interchangeably mounted on either side of the motor unit 14.

The roller assembly 10 includes a first bracket 28 and a second bracket 30 which are located on either side of the motor unit 14. Each bracket 28, 30 has a distal portion 32, 34 and a proximal portion 36, 38. The proximal portions 36, 38 of the brackets 28, 30 have holes 40, 42 and 44, 46 therethrough for mounting the brackets to the machine.

An axle 48 (See FIG. 5) is securely mounted transversely of the machine 12 in bearing assemblies 50, 52 which are press fit in the distal portions 32, 34 of the brackets 28, 30. Rollers 58, 60 can then be placed over the axle 48 (See FIG. 6) and, as seen in FIG. 1, an attachment 62 can then be placed over the rollers 58, 60. As shown in FIG. 7, the attachment 62 is a foam pad, but the attachment 62 can be sandpaper, a wire brush, or other items. Note that as shown the rollers 58, 60 are made of aluminum, however the rollers 58, 60 can be made of any suitable material and need not be made of aluminum.

Figure 2:
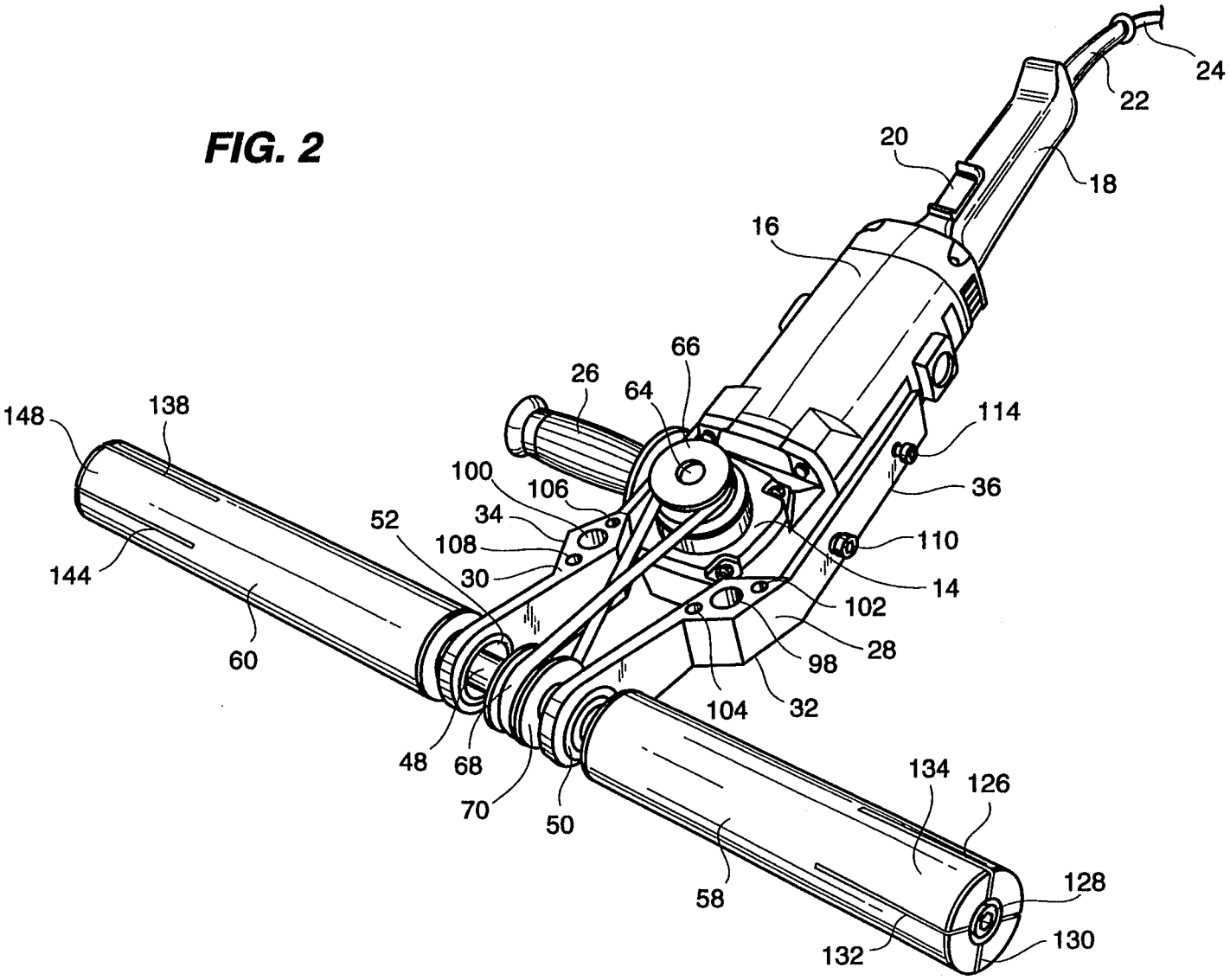
FIG. 2 is a bottom perspective view of the roller assembly of FIG. 1, mounted on the conventional hand held rotary disk buffing machine.

As shown in FIG. 2, a driveshaft 64 extends from the motor. The drive shaft 64 rotates when the motor is powered on. The speed of rotation of the drive shaft 64 can be varied on some machines 12, such that typically the drive shaft 64 can rotate from about 1400 to 3400 revolutions per minute.

A first pulley 66 is mounted on the drive shaft 64 of the motor unit 14. The first pulley 66 replaces a conventional rotary disk (not shown) which is usually mounted on the drive shaft 64 of a conventional disk buffing machines 12. The first pulley 66 can be threadedly attached to the drive shaft 64 in the same manner as a conventional disk would be threaded to the drive shaft 64.

A belt 68 is looped around the first pulley 66 and around a second pulley 70 which is mounted on the axle 48 of the assembly 10. The belt 68 when looped around the first pulley 66 and the second pulley 70 undergoes a quarter circle twist because the planes in which the first pulley 66 and the second pulley 70 rotate are substantially normal to each other. The belt 68 can be made of rubber, nylon or a composite of nylon and rubber.

Figure 3:
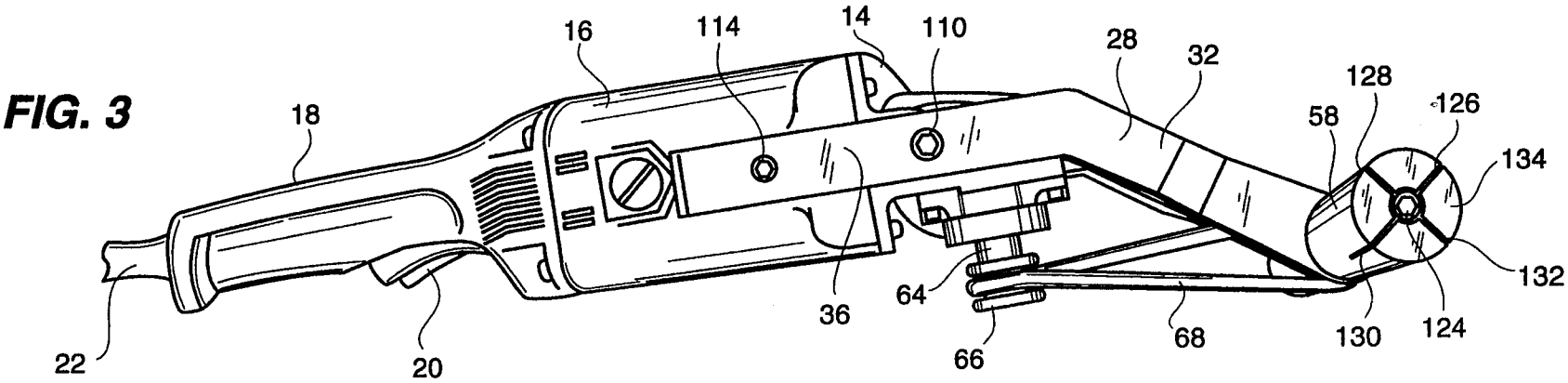
FIG. 3 is side view of the roller assembly of FIG. 1 mounted on the conventional hand held rotary disk buffing machine.

As shown in the side view of FIG. 3, the distal portion 32 of the bracket 28 extends from the proximal portion 36 of the bracket 28 at approximately a 45° angle. The angle between the distal portion 32 and the proximal portion 36 of the bracket 28 helps prevent the belt 68 from hitting furniture or other objects being worked on. Adverse wear on the belt 68 is also prevented because the belt 68 cannot come into contact with the surface being worked on. The angled brackets 28, 30 also provide an approximate 90° angle between the drive shaft 64 and the belt 68 for enhancing operation of the machine 12.

Figure 4:
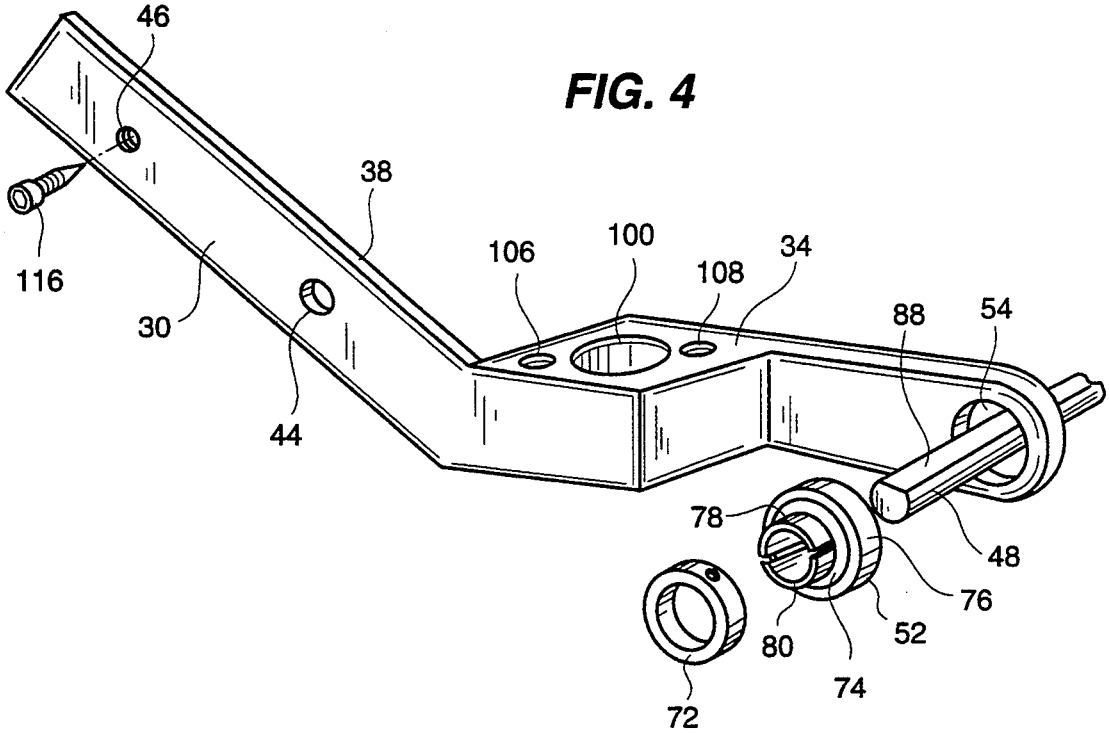
FIG. 4 is a perspective side view of one bracket of the roller assembly showing an axle and bearing assembly exploded from the bracket.

FIG. 4 shows a side view of one of the brackets 30 having a bearing assembly 52 and a collar 72 exploded from the bracket 30. The bearing assembly 52 has an inner race 74, an outer race 76 and two semi-circular portions 78, 80 extending from the inner race 74. The outer race 76 of the bearing assembly 52 is generally press fit into a bore 54 in the distal portion 34 of the bracket 30 making the bracket 30 and bearing assembly 52 an integral unit.

The axle 48 is then placed within the inner race 74 of the bearing assembly 52 in the distal portion 34 of the bracket 30 and extends through the semi-circular extensions 78, 80 of the bearing assembly 52. The inner race 74 of the bearing assembly 52 can rotate relative to the fixed outer race 76. The other bracket 28 has a bearing assembly 50 mounted in its distal portion 32 and receives the axle 48 in the same manner.

Each collar 72, 82 slides over semi-circular extended portions 78, 80 of each bearing assembly 50, 52. Each collar 72, 82 has a threaded bore 84, 86 for receiving a set screw. The set screws in the collars 72, 82 securely fasten the axle 48 to the bearing assemblies 50, 52 by forcing one of the semi-circular extended portions 78 or 80 to engage the axle 48. Thus the collars 72, 82, the extended portions 78, 80, the inner races 74 and the axle 48 rotate together when the axle 48 is driven by the belt 68.

Note that the axle 48 and brackets 28, 30 can be adjusted to fit different size motor units 14 by simply securing the bearing assembles 50, 52 to the axle 48 at different points along the axle 48. Also note that the size of the axle 48 can be varied, i.e a longer/shorter axle 48 can be used or an axle 48 with a larger/smaller diameter can be used.

Figure 5:
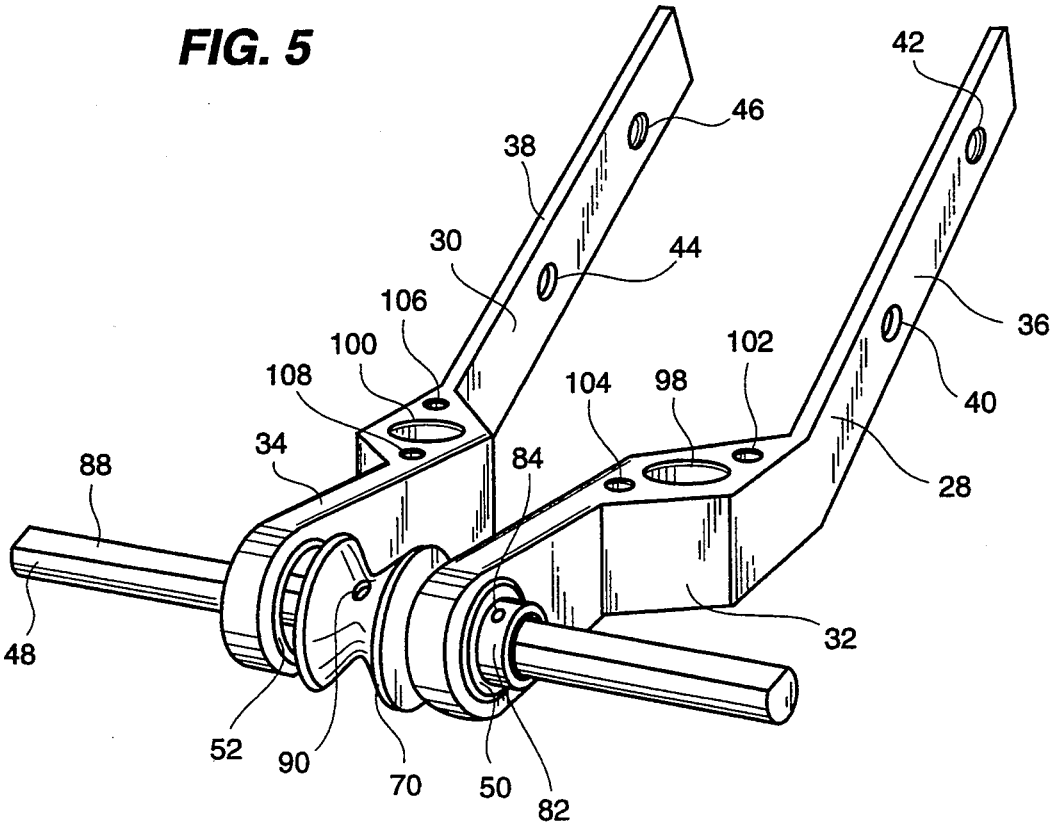
FIG. 5 is a bottom perspective view of the assembled roller assembly of FIG. 2 but not mounted to the disk buffing machine.

FIG. 5 shows a bottom perspective view of the bracket assembly 10 in which the bearing assemblies 50, 52 are press fit into the brackets 28, 30 and in which the collars 82, 72 securely hold the axle 48 in place.

Also shown is the second pulley 70 mounted on the axle 48 between the brackets 28, 30. A flat 88 on the axle 48 can be seen here. The second pulley 70 is secured to the axle 48 by a set screw (not shown) threaded through a radial bore 90 in the pulley 70 and the flat 88 on the axle 48 provides a stop surface for holding the set screw.

Figure 11:
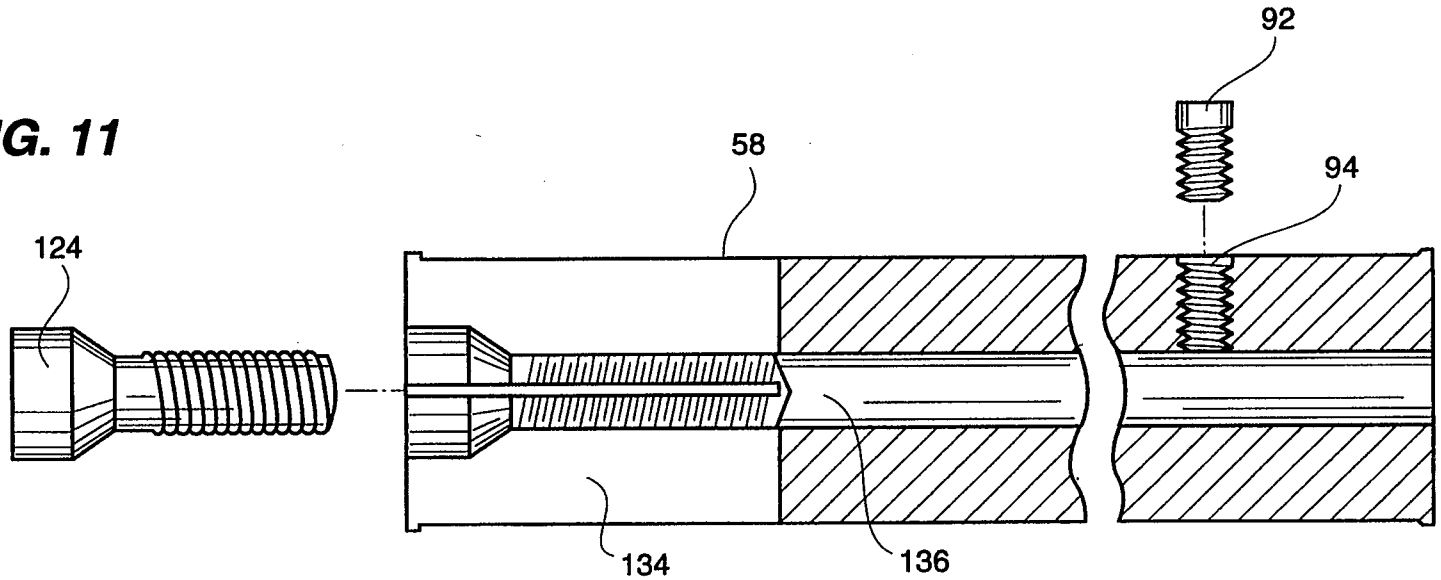
FIG. 11 is a sectional side view of the roller shown in FIG. 10 and is taken along line 11—11 of FIG. 10.

The set screws used in the bracket assembly 10 are flat bottom set screws similar to the set screw 92 shown in FIG. 11. Note that the second pulley 70 is positioned between the two brackets 28, 30 toward their distal portions 32, 34 and must be placed at least on the axle 48 before at least one of the brackets 28 or 30 is received or is secured to the axle 48

Figure 6:
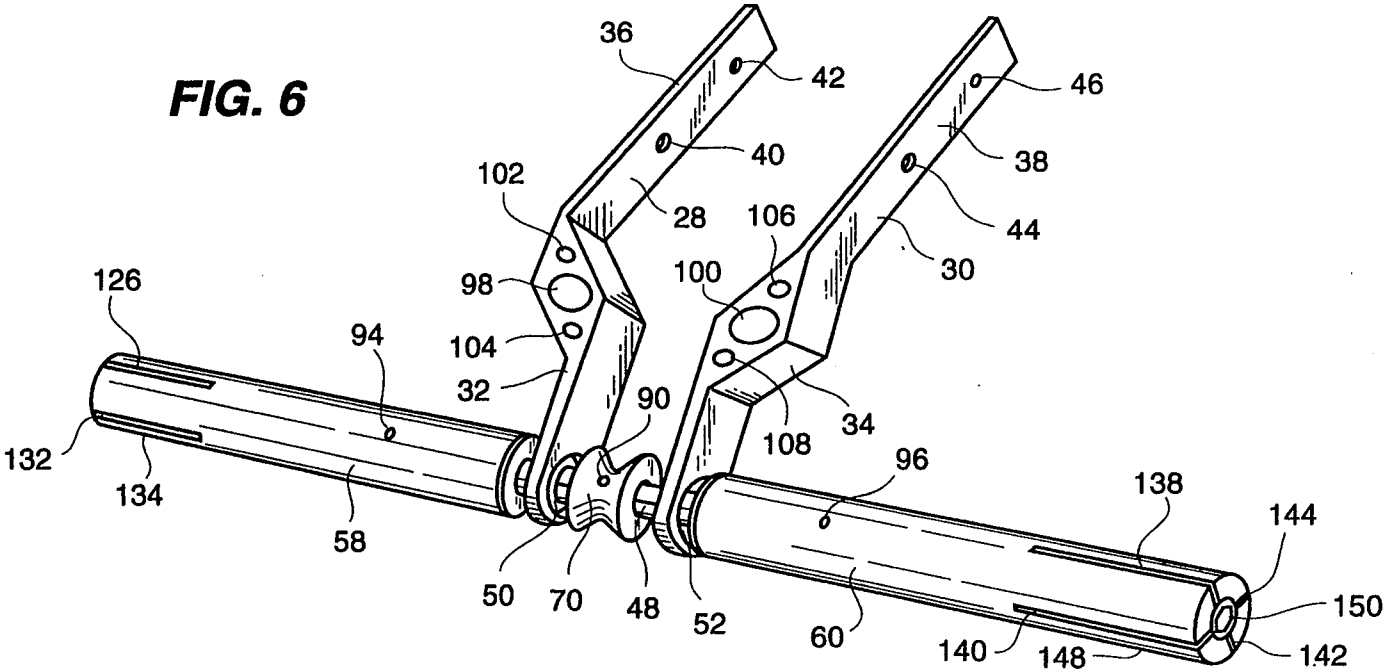
FIG. 6 is a top perspective view of the assembled roller assembly FIG. 1 but not mounted to the disk buffing machine.
Figure 7:
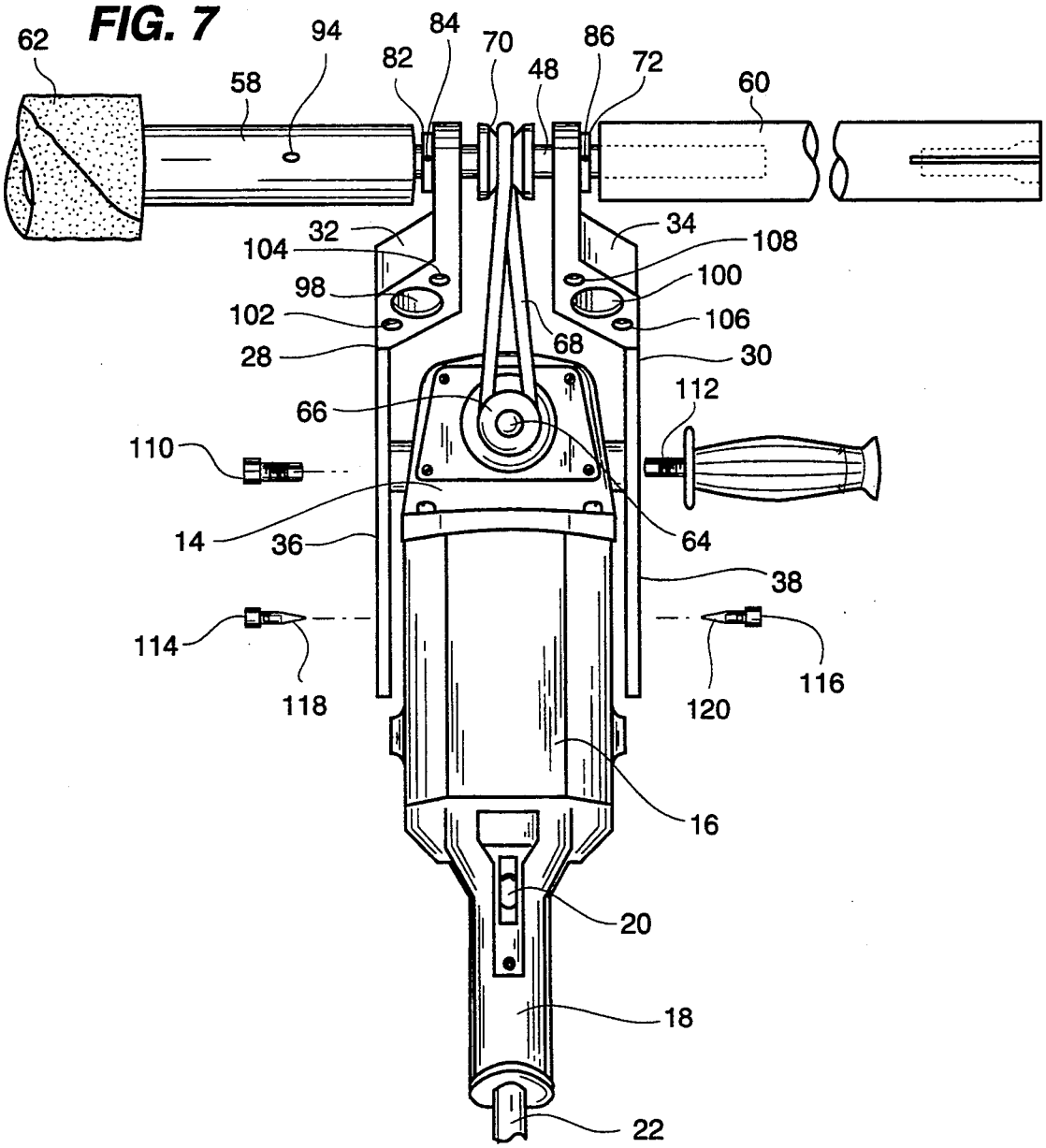
FIG. 7 is a bottom view of the roller assembly and disk buffing machine showing an exploded view of a handle, bolts and set screws used for mounting the assembly to the disk buffing machine.

As shown in FIG. 6, the rollers 58, 60 can be slidingly placed over the axle 48. The rollers 58, 60, like the second pulley 70, have small threaded radial bores 94, 96 therethrough, which receive small set screws 92 which securely hold the rollers 58, 60 to the axle 48. The set screws 92 are flat bottom set screws as shown in FIG. 11. The flat bottom set screws 92 bear against flats 88 on of the axle 48 in the same fashion as the second pulley 70 set screw. The rollers 58, 60 can be adjusted axially so that they are secured at various positions along the axle 48, so long as the set screw 92 meets the axle 48.

As shown in FIGS. 4–6, the distal portion 32, 34 of each bracket 28, 30 has one large bore 98, 100 and two small bores 102, 104 and 106, 108. These bores 98, 100, 102, 104, 106 and 108 are provided for weight relief 28, 30 as the brackets are made of aluminum and can be quite heavy. The bores 98, 100, 102, 104, 106 and 108 can also be used to mount a guard or other attachment. Note however that the brackets 28, 30 can be made of any suitable material and need not be made of aluminum.

A bottom view of the assembly 10 mounted on a conventional hand held rotary disk buffing machine 12, is shown in FIG. 7. Here an exploded view of the bolts 110, 112 which hold the brackets 28, 30 to the machine 12 are shown. Note that the bolts 110, 112 pass through the brackets 28, 30 and are inserted into threads (not shown) which are present on commercially available hand held machines 12. One of the bolts 12 can have the handle 26 attached thereto and can be placed on either side of the assembly 10.

FIG. 7 also shows a pointed set screw 114, 116 which also are used in mounting the brackets 28, 30 to the machine 12. The set screws 114, 116 have tapered ends 118, 120 and are generally driven into and bear against the plastic housing 16 of the machine 12.

The combination of the bolts 110, 112 and the set screws 114, 116 securely hold the brackets 28, 30 to the machine 12. However, the brackets 28, 30 can be mounted in any other suitable fashion to the machine 12.

Figure 8:
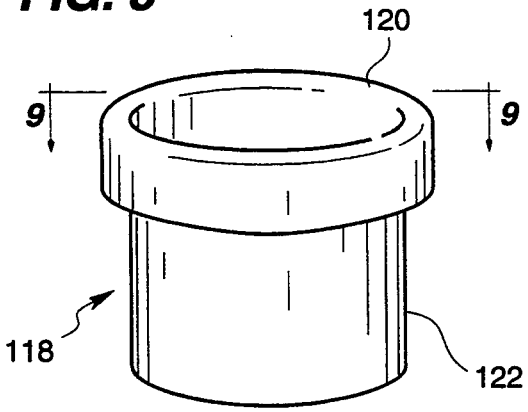
FIG. 8 is a perspective view of a plastic sleeve used to place a rolled piece of sandpaper over a foam pad on the roller.
Figure 9:
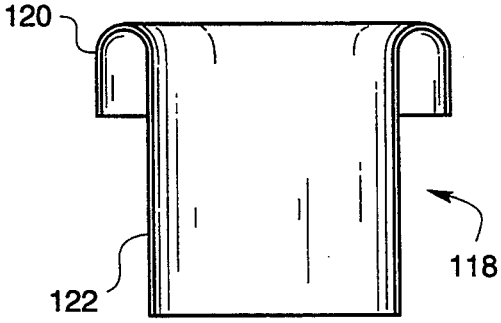
FIG. 9 is a side view of the plastic sleeve of FIG. 8 taken along line 9—9 of FIG. 8.

A tubular sleeve 118, shown in FIGS. 8 and 9, allows a user to attach sandpaper rolls over the foam pad attachments 62 on the rollers 58, 60. The sleeve 118 has a rounded end portion 120 and a hollow body portion 122. The sandpaper roll is slid on the outside of the body portion 122 of the sleeve 118. The diameter of the sleeve 118 is slightly larger than the diameter of the roller 58, 60. The sleeve 118 is then slid over the foam pad 62, the rounded end 120 first, so as to compress the foam pad 62 and allow the rest of the sleeve 118 to slide over the pad 62. When the sleeve 118 is positioned over the roller 58, 62, the sandpaper roll is grasped and held to the foam pad 62, while the sleeve 118 is drawn off the foam pad 62 by being drawn in the same direction along the axle 48. The foam pad 62 then expands slightly, to secure firmly the sandpaper roll to the foam pad 62.

Figure 10:
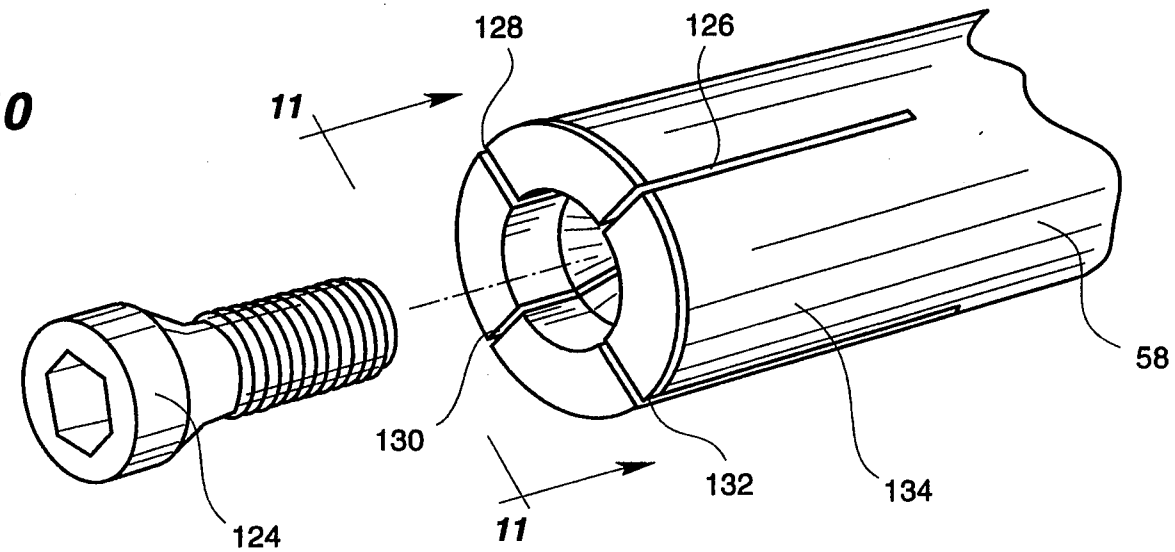
FIG. 10 is a perspective view of an end of a roller of the roller assembly shown in FIG. 1.

FIG. 10 is a perspective view of a roller 58 and a conical shaped set screw 124. Note that the roller 58 has four equally spaced slits 126, 128, 130, 132 which run parallel to a longitudinal axis of the roller 58 at a distal end 134 of the roller 58. The slits 126, 128, 130, 132 allow the distal end 134 of the roller 58 to slightly expand or contract. The distal end 134 of the roller 58 contracts slightly when an attachment 62 is slid onto the roller 58.

As shown in FIG. 11 the roller 58 also has an axial bore 136 extending along the roller's longitudinal axis. The bore 136 is threaded at the distal end 134 of the roller 58. After an attachment is placed on the roller 58, the conical shaped set screw 124 is threaded into the bore 136 and the roller 58 expands slightly, thus preventing the attachment mounted on the roller 58 from coming off during use. Note that the other roller 60 also has slits 138, 140, 142, and 144 at its distal end 148 and receives a conical shaped set screw 150 in the same manner as the roller 58.

From the foregoing description, it will be understood that modifications can be made to the bracket assembly constructed according to the teachings of the present invention and described above. Also, it will be apparent that the bracket assembly described above has a number of advantages and features, some of which have been disclosed above and others of which are inherent therein. Accordingly, the scope of the invention is only to be limited as necessitated by the accompanying claims.

I claim:

1. A roller assembly adapted for use on a conventional hand held rotary disk buffing machine including a motor with a drive shaft extending from the motor, said roller assembly comprising:

a bracket assembly including a first bracket and a second bracket, each of said brackets having a proximal portion and a distal portion, and said proximal portion being mounted to said machine;

an axle;

means for rotably mounting said axle transversely of said machine on said distal portions of said brackets;

a first pulley attached to the drive shaft;

a second pulley attached to said axle;

means for coupling said pulleys and for rotating said axle when the drive shaft is driven by the motor; and at least one roller mounted to said axle.

2. The roller assembly of claim 1 wherein said roller has a threaded radial bore therethrough; and includes a set screw threaded in said radial bore to bear against said axle to attach said roller to said axle.

3. The roller assembly of claim 1 wherein said roller has slits at an outer end of said roller;

said slits extending along an outer periphery of said roller parallel to said longitudinal axis, and extending approximately 2".

4. The roller assembly of claim 3 wherein said axial bore is threaded at said outer end of said roller, for receiving a cone shaped screw;

said cone shaped screw causing said roller to expand slightly at said slits when said cone shaped screw is threaded into said roller in order to keep the attachment mounted on said roller.

5. The roller assembly of claim 4 wherein the attachment is a buffer pad.

6. The roller assembly of claim 4 wherein the attachment is sandpaper.

7. The roller assembly of claim 4 wherein the attachment is a wire brush.

8. The roller assembly of claim 1 wherein said means for coupling said pulleys and rotating said axle is a rubber belt looped around said first and said second pulleys.

9. The roller assembly of claim 1 wherein said distal portions of said brackets extend from said proximal portions of said brackets at approximately a 45° angle.

10. The roller assembly of claim 1 wherein said roller is made of aluminum.

11. The roller assembly of claim 1 wherein said brackets are made of aluminum and have various openings therethrough for weight relief.

12. The roller assembly of claim 1 wherein said brackets have bores therethrough for mounting said brackets to said machine and bolts and set screws are used to mount said brackets to the machine, said bolts being of the type used in conventional machines to attach a handle to the unit, whereby said bolts extend through said bores and are received in threaded receptacles in a body of the conventional disk buffing machine and said set screws extend through other bores in said brackets and bear against a housing of the disk buffing machine.

13. The roller assembly of claim 1 wherein said axle is rotably mounted to said axle transversely of said machine by lock bearings mounted in said distal portions of said brackets and a collar which is fitted over said axle and said bearing to fix said axle to said bearing.

14. A roller assembly to be adapted for use on a conventional hand held rotary disk buffing machine having a motor unit, a drive shaft extending from the motor unit, and a rotary disk attached to the drive shaft comprising:

a first pulley attached to said drive shaft, replacing the conventional rotary disk;

a bracket assembly including a first bracket and a second bracket, each of said brackets having a proximal portion and a distal portion;

means for mounting said brackets to either side of the motor unit;

an axle having a second pulley attached thereto;

means for rotably mounting said axle transversely of said machine on said distal portions of said brackets;

means, coupled to said first and said second pulley for rotating said axle when the drive shaft is driven by the motor unit; and at least one roller mounted on said axle.

15. The roller assembly of claim 14 wherein said means for rotably mounting said axle transversely of said machine include lock bearings press fit in said distal portions of said brackets.

16. The roller assembly of claim 15 further including an attachment to be mounted on said roller.

17. The roller assembly of claim 16 including means for mounting the attachment on said roller.

18. The roller assembly of claim 17 wherein said means for mounting the attachment on said roller is a hollow tube having a rounded edge.

* * * * *